United States Patent [19]

Cornwell, Jr.

[11] 3,981,413

[45] Sept. 21, 1976

[54] MAILBOX DOOR MOUNTING ARRANGEMENT

[75] Inventor: Alexander M. Cornwell, Jr., St. Louis, Mo.

[73] Assignee: Jackes-Evans Manufacturing Company, St. Louis, Mo.

[22] Filed: Apr. 28, 1975

[21] Appl. No.: 568,482

[52] U.S. Cl. ..... 220/334; 232/17

[51] Int. Cl.[2] ..... B65D 43/14; B65D 51/04

[58] Field of Search ..... 220/334; 217/57; 232/17; 16/128 R, 128 A

[56] References Cited

UNITED STATES PATENTS

| | | | |
|---|---|---|---|
| 1,817,310 | 8/1931 | Hauch | 220/334 |
| 3,411,653 | 11/1968 | Pearce | 220/334 X |

*Primary Examiner*—George T. Hall

*Attorney, Agent, or Firm*—Haight, Hofeldt, Davis & Jambor

[57] ABSTRACT

A door for a mailbox that has an open end to be selectively closed by the door, the mailbox being of the free standing type most frequently encountered in rural areas, is pivotally mounted on the mailbox by an improved hinging arrangement. A solid flat bar is secured to the door by an appropriate fastening arrangement, such as rivets. Transversely extending supporting arms, one at each end of the flat bar, are pivotedly connected to opposite sides of the mailbox by an appropriate mounting structure, such as rivets that are not completely tightened. The supporting arms may be integrally formed with the flat bar, and a transversely extending flange may also be integrally formed with the bar to provide additional strength.

10 Claims, 4 Drawing Figures

MAILBOX DOOR MOUNTING ARRANGEMENT

BACKGROUND OF THE INVENTION

1. Field of the Invention

This invention relates generally to a mounting arrangement for a mailbox door, and more specifically, this invention relates to a rivet type pivotal mounting for large mailbox doors.

2. Description of the Prior Art

For many years, the doors of small mailboxes, of the type having an open end to be selectively closed by the door, have been mounted by means of loosely tightened rivets. In this type of arrangement, the rivets would be passed through a portion of the door, such as an extending flange thereof, and through the appropriate sidewalls of the mailbox. While this arrangement works sufficiently well for small mailboxes, it was found to be unsatisfactory for larger mailboxes, such as the large rural mailboxes, due to the greater size of the door which resulted in bending or distortion of the door. Such distortion, especially when coupled with the weight of the door, produced binding and generally unreliable operation, as well as breaking of the doors.

Accordingly, for the larger mailboxes a more conventional hinge, of the type known as a "piano" hinge, has been utilized. This type of hinge has two leaf members, each leaf having a plurality of annular cylindrical pivot sections adapted to interlace with the pivot sections of the other leaf. A pivot rod is then passed through the pivot sections to maintain the leafs together and to provide a pivot point during use of the hinge. Such hinges are relatively expensive, due to the manufacture of three relatively complicated parts and the consequent assembly time.

In connecting the piano hinges for use on the mailbox door, one leaf is connected to the door by five rivets, while the other leaf is connected to a portion of the mailbox, such as an extending flange at the bottom of the mailbox, by five rivets also. Thus, additional costs are involved in using the total of ten rivets, and in the labor that is required to fasten the rivets.

As a consequence, the presently utilized mounting arrangement for large mailbox doors is relatively expensive. In addition, the necessity of having the premanufactured piano hinges on hand creates purchasing and storage problems.

SUMMARY OF THE INVENTION

The present invention provides a pivotal mounting for large mailbox doors that is less expensive than that presently used and is considerably easier to assemble. This is achieved by means of a rivet mounting arrangement which avoids the problems involved with prior art rivet type mountings for small mailboxes when utilized with large mailbox doors.

A flat bar is extended across the bottom portion of the mailbox door. This flat bar is secured to the bottom portion of the door by any suitable fastening arrangement, the preferred form illustrated herein being three rivets at spaced intervals. Supporting members or arms extend generally transversely to the flat bar from each end thereof. In the preferred embodiment hereof, these supporting arms are integrally formed with the flat bar, and each has two portions transverse to the flat bar. The first of these portions is affixed to the bar, with these first portions of the two supporting arms being separated by a distance less than the width of the mailbox. The second portions are spaced outwardly from the first portions and are separated by a distance approximately equal to the width of the mailbox. The first and second portions are interconnected by a third portion. The second portions of the supporting arms are pivotally connected to the sides of the mailbox, such as by rivets. As opposed to the rivets that connect the flat bar to the door, these rivets are not completely tightened, so that a pivotal mounting is provided. A flange integrally formed with the flat bar and extending in the same direction as the supporting arms transverse to the flat bar, lies along substantially the entire length of the flat bar. This flange provides additional strength for the flat bar and the entire hinge arrangement.

With this structure, a simplified, less expensive and more easily assembled mounting arrangement is provided. The entire hinge assembly can be formed by a blanking and forming operation on one piece, as opposed to the manufacture and assembly of three different pieces as in the case of the piano hinges. Also, as the piano hinge needed 10 rivets to connect it to the door and mailbox, while the arrangement of this application only requires five rivets, the assembly costs are reduced. Further, since the piano hinges had to be bought outside the company, while the new hinge can be produced in-house, the problems of purchasing, receiving and storing, including ordering at a sufficient lead time to keep an inventory on hand but without the inventory becoming excessively large, are all obviated.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
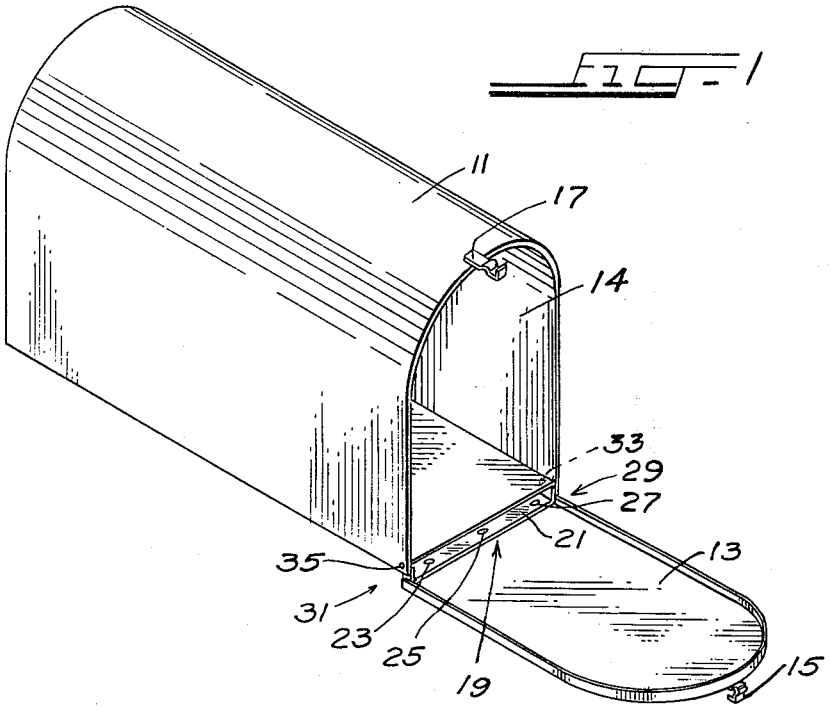
FIG. 1 is a perspective view of a mailbox incorporating the door mounting arrangement of this invention.

In the perspective view of FIG. 1, there is shown a mailbox 11 having a door 13. Mailbox 11 is of a relatively large size, such as that normally found primarily in rural areas. Door 13 is adapted to selectively close an open end 14 of mailbox 11. When door 13 is closed, it is latched in the closed position, such as by engagement of the latch member 15 thereon with a latch engaging member 17 on the mailbox. Door 13 is pivotally mounted on the mailbox 11 by means of a mounting device or structure 19. Mounting device 19 includes a flat bar 21 that is securely fastened to door 13 by any suitable fastening arrangement. In this preferred embodiment, three fastening rivets 23, 25, and 27 are utilized to achieve secure fastening of flat bar 21 to door 13.

At each end of flat bar 21 there are extended supporting members or arms 29 and 31 that are generally transverse to the flat bar 21. Supporting arms 29 and 31 are rigidly connected to flat bar 21 and are pivotally connected to the sides of mailbox 11 by support rivets 33 and 35. In order to provide the pivotal connection, rivets 33 and 35 are not completely tightened, as opposed to the rivets 23, 25 and 27, which are completely tightened to securely and rigidly fasten flat bar 21 to door 13.

Figure 2:
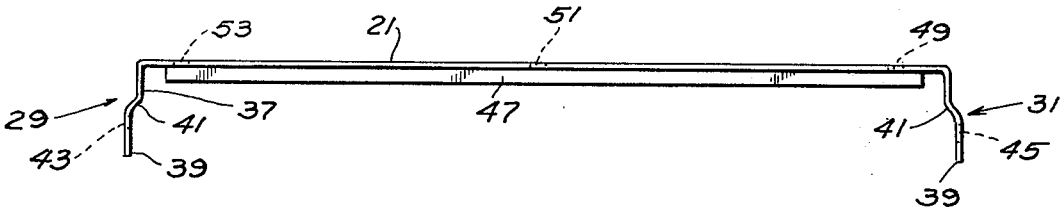
FIG. 2 is a top plan view of the mounting structure of this invention.
Figure 3:
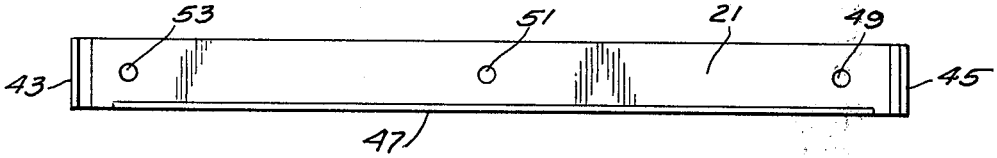
FIG. 3 is a front elevational view of the device of FIG. 2.
Figure 4:
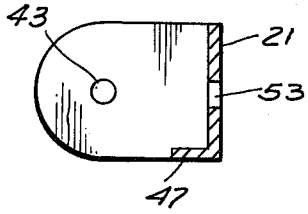
FIG. 4 is a cross-sectional view taken along line 4 — 4 of FIG. 3.

The hinge mounting structure for door 13 is shown in greater detail in FIGS. 2–4. In FIG. 2, it may be seen that the supporting arms 29 and 31 are, in this preferred embodiment, formed integrally with the flat bar 21. Each of these supporting arms 29 and 31 has a first portion 37 connected directly to the flat bar 21 and extending substantially transversely thereto. A second portion 39 of each of the arms is spaced outwardly from the portion 37 and extends parallel thereto (i.e., transversely to the flat bar 21). A third portion 41 interconnects the first portions 37 and the second portions 39.

It may be noted that the first portions 37 of supporting arms 20 and 31 are separated by a distance less than the width of the mailbox, while the second portions 39 are separated by a distance that is substantially equal to the width of the mailbox. In this preferred embodiment, the portions 39 fit inside depending flanges formed by the walls of mailbox 11 extending below the bottom thereof, although it should be understood that portions 39 could also fit over the outside of the walls of the mailbox. The portions 39 are connected to the sides of the mailbox by rivets 33 and 35 passing through openings 43 and 45, respectively. The rivets 33 and 35 are not completely tightened, and there's enough clearance between the rivets and the inner circumferences of the openings 43 and 45 (and/or the openings in the mailbox) to permit pivotal motion of door 13 with respect to mailbox 11. A strengthening flange 47 is integrally formed with bar 21 and extends transversely thereto along substantially the entire length thereof. It may be noted that the strengthening flange 47 extends in the same directions as the supporting arms 29 and 31.

Openings 49, 51 and 53 are formed in the flat bar 21 to provide passage of the rivets 23, 25 and 27, respectively. These rivets are completely tightened to securely fasten the flat bar 21 to the mailbox door 13.

With this structure, the door 13 is pivotally connected to the mailbox 11 for hingedly openings and closing the open end 14 of mailbox 11. The flat bar 21 provides a strong mounting support that precludes bending, twisting or other distortions of the mailbox door 13, with the cost, assembly and other attendant advantages heretofore discussed.

It should be understood that various modifications, changes and variations may be made in the arrangements, operation and details of construction of the elements disclosed herein without departing from the spirit and scope of this invention.

I claim:

1. A mounting arrangement for a mailbox door, the mailbox having an open end to be selectively closed by a door, comprising:

a rigid flat bar extending across the door adjacent the bottom thereof;

fastening means for securing said flat bar to the door to strengthen the door against distortion, said fastening means precluding relative movement between said flat bar and the door;

supporting members rigidly connected to said flat bar and extending generally transversely thereto at each end thereof; and mounting means for pivotally connecting said supporting members to either side of the mailbox, the connection of said supporting members to the side of the mailbox and the use of said rigid flat bar stengthening the mailbox as well as the door against distortion.

2. A mounting arrangement is claimed in claim 1 wherein said flat bar and said supporting members are integrally formed.

3. A mounting arrangement as claimed in claim 1 wherein said fastening means comprises three rivets rigidly interconnecting said flat bar and the door.

4. A mounting arrangement as claimed in claim 1 wherein said mounting means comprises two rivets, each of said rivets interconnecting one of said supporting members and a side of the mailbox.

5. A mounting arrangement as claimed in claim 1 and further comprising a strengthening flange along one side of said flat bar.

6. A mounting arrangement for a mailbox, the mailbox having an open end to be selectively closed by the door, comprising:

a flat bar extending across the door adjacent the bottom thereof;

A strengthening flange integrally formed with said flat bar and extending generally transversely thereto for substantially the entire length thereof;

three fastening rivets rigidly securing said flat bar to the door at spaced intervals therealong;

a pair of supporting arms, integrally formed with said flat bar, one of said supporting arms at each end of said flat bar and extending generally transversely to said bar in the same direction as said strengthening flange, said supporting arms extending along opposite sides of the mailbox; and a pair of support rivets, each of said support rivets connecting an associated one of said supporting arms to a side of the mailbox, said support rivets not being completely tightened so that the door is pivotally mounted on the mailbox.

7. A mounting arrangement as claimed in claim 6 wherein each of said supporting arms comprises:

a first portion connected to said flat bar and extending transversely thereto, the distance separating said first portions being less than the width of the mailbox;

a second portion spaced from said first portion and extending transversely to said flat bar, the distance separating said second portions substantially equaling the width of the mailbox, so that said second portions pass adjacent the inner surfaces of each side of the mailbox; and a third portion interconnecting said first portion and said second portion.

8. A mounting arrangement for a mailbox, the mailbox having an open end to be selectively closed by a door, comprising:

a flat bar extending across the door adjacent the bottom thereof;

a strengthening flange integrally formed with said flat bar and extending generally transversely thereto for substantially the entire length thereof;

fastening means rigidly securing said flat bar to the door at spaced intervals therealong;

a pair of supporting arms, integrally formed with said flat bar, one of said supporting arms at each end of said flat bar and extending generally transversely to said bar in the same direction as said strengthening flange, said supporting arms extending along opposite sides of the mailbox; and a pair of support rivets, each of said support rivets connecting an associated one of said supporting arms to a side of the mailbox, said support rivets not being completely tightened so that the door is pivotally mounted on the mailbox.

9. A mounting arrangement as claimed in claim 8 wherein each of said supporting arms comprises:

a first portion connected to said flat bar and extending transversely thereto, the distance separating said first portions being less than the width of the mailbox;

a second portion spaced from said first portion and extending transversely to said flat bar, the distance separating said second portions substantially equaling the width of the mailbox, so that said second portions pass adjacent the inner surfaces of each side of the mailbox; and a third portion interconnecting said first portion and said second portion.

10. A mounting arrangement for a mailbox door, the mailbox having an open end to be selectively closed by a door, comprising:

a rigid member having a length substantially the same as the width of the open end of the mailbox;

fastening means for securing said rigid member to the mailbox door adjacent the bottom end thereof to strengthen the door against distortion, said fastening means precluding relative movement between said rigid member and the door;

supporting members fixedly connected to said rigid member and extending generally transversely thereto at each end thereof; and mounting means for pivotally connecting one of said supporting members to each side of the mailbox, the connection of said supporting members to the side of the mailbox and the use of said flat bar strengthening the mailbox as well as the door against distortions.

* * * * *